US011680356B2

(12) United States Patent
Li et al.

(10) Patent No.: US 11,680,356 B2
(45) Date of Patent: Jun. 20, 2023

(54) INNER DRUM AND NO-CLEAN WASHING MACHINE

(71) Applicants: QINGDAO HAIER WASHING MACHINE CO., LTD., Shandong (CN); QINGDAO HAIER SMART TECHNOLOGY R&D CO., LTD., Shandong (CN); HAIER SMART HOME CO., LTD., Shandong (CN)

(72) Inventors: Yimin Li, Shandong (CN); Chunfeng Lao, Shandong (CN); Xinghui Hao, Shandong (CN); Di Wu, Shandong (CN); Peishi Lv, Shandong (CN)

(73) Assignees: QINGDAO HAIER WASHING MACHINE CO., LTD., Shandong (CN); QINGDAO HAIER SMART TECHNOLOGY R&D CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 359 days.

(21) Appl. No.: 16/975,860

(22) PCT Filed: Feb. 21, 2019

(86) PCT No.: PCT/CN2019/075736
§ 371 (c)(1),
(2) Date: Aug. 26, 2020

(87) PCT Pub. No.: WO2019/165925
PCT Pub. Date: Sep. 6, 2019

(65) Prior Publication Data

US 2020/0407906 A1 Dec. 31, 2020

(30) Foreign Application Priority Data

Feb. 27, 2018 (CN) ..... 201810163964.6

(51) Int. Cl.
*D06F 39/08* (2006.01)
*D06F 23/02* (2006.01)
*D06F 37/06* (2006.01)

(52) U.S. Cl.
CPC ..... *D06F 39/083* (2013.01); *D06F 23/02* (2013.01); *D06F 37/065* (2013.01)

(58) Field of Classification Search
CPC ..... D06F 39/083; D06F 23/02; D06F 37/065; D06F 23/025; D06F 37/06; D06F 33/42; D06F 37/42; D06F 37/04; D06F 39/08
See application file for complete search history.

(56) References Cited

U.S. PATENT DOCUMENTS 4,941,333 A 7/1990 Blessing
2005/0097926 A1 5/2005 Kim et al.
(Continued)

FOREIGN PATENT DOCUMENTS

CN 1616747 A 5/2005
CN 2908584 Y 6/2007
(Continued)

OTHER PUBLICATIONS

International Search Report (PCT/ISA/210), with translation, and Written Opinion (PCT/ISA/237) dated May 28, 2019, by the Chinese Patent Office as the International Searching Authority for International Application No. PCT/CN2019/075736.

*Primary Examiner* — Michael E Barr
*Assistant Examiner* — Pallavi Chitta
(74) *Attorney, Agent, or Firm* — Buchanan Ingersoll & Rooney PC

(57) ABSTRACT

An inner drum comprises lifting ribs extending along a generatrix of the inner drum, each being hollow inside, a water-splashing surface of each of the lifting ribs has permeable holes to allow a hollow part of each of the lifting ribs
(Continued)

to communicate with an inside of the inner drum, and a rear end of each is arranged close to an inner drum bottom, and provided with a water outlet structure. A no-clean washing machine is installed with the inner drum, the inner drum is a closed container with an opening closed by a door. When the inner drum rotates at a high speed, the washing water is guided towards the inner drum bottom and flows to a center of the bottom along a water guide flow channel on the bottom, and is discharged out of the inner drum through a water outlet connector of a central joint.

19 Claims, 8 Drawing Sheets

(56) References Cited

U.S. PATENT DOCUMENTS

| | | | |
|---|---|---|---|
| 2015/0176173 | A1 | 6/2015 | Kim et al. |
| 2015/0176177 | A1 | 6/2015 | Kim |

FOREIGN PATENT DOCUMENTS

| | | | | |
|---|---|---|---|---|
| CN | 101400842 | A | 4/2009 | |
| CN | 101812793 | A | 8/2010 | |
| CN | 104727077 | A | 6/2015 | |
| CN | 105696248 | A | 6/2016 | |
| CN | 106436138 | A | 2/2017 | |
| CN | 206189091 | U | 5/2017 | |
| CN | 206266887 | U | 6/2017 | |
| CN | 206266888 | U | 6/2017 | |
| CN | 206266889 | U | 6/2017 | |
| EP | 2270272 | B1 * | 9/2012 | ..... D06F 37/065 |
| EP | 3279387 | A1 | 2/2018 | |
| KR | 20130123540 | A | 11/2013 | |

* cited by examiner

INNER DRUM AND NO-CLEAN WASHING MACHINE

TECHNICAL FIELD

The present disclosure belongs to the technical field of washing machines, in particular relates to a washing machine which is only provided with a rotatable inner drum which can accommodate water, and further relates to an inner drum applicable to the above washing machine.

BACKGROUND

In the prior art, a drum washing machine generally includes an inner drum and an outer drum which are sleeved mutually, wherein the outer drum is sealed to accommodate water, and the inner drum is configured to accommodate clothes and beat and wash clothes via rotation of the inner drum. Meanwhile, the inner drum is provided with water dehydrating holes, such that water in the outer drum flows into the inner drum through the water dehydrating holes to soak clothes in the inner drum, water in the inner drum flows to the outer drum through the water dehydrating holes, and moisture on the clothes in the inner drum is discharged out to the outer drum through the water dehydrating holes when the inner drum rotates at a high speed, to realize the purpose of washing clothes.

However, since the inner drum and the outer drum are sleeved mutually, in the using process of the washing machine, dirt easily accumulates between the inner drum and the outer drum. Meanwhile, since the inner drum and the outer drum are sleeved mutually, users cannot clean an outer wall of the inner drum and an inner wall of the outer drum, such that bacteria inside the washing machine increase, thereby lowering washing efficiency of the washing machine and lowering cleanliness of clothes after washing.

Meanwhile, in the above existing washing machine, since an outer side of the inner drum is sleeved with the outer drum, as to the washing process of the washing machine, clothes are beaten and washed via rotation of the inner drum, such that the washing capacity of the washing machine is based on the inner drum, an internal space of the washing machine is low in using efficiency, and the washing capacity of the washing machine cannot be expanded on the existing basis.

In view of this, it has become a research hotspot of how to set a washing machine to integrate the inner drum with the outer drum or directly set a closed inner drum, such that the inner drum is set to be a closed container, then the inner drum can accommodate water and clothes and can also rotate to beat clothes for washing, and also the problem that the space between the inner drum and the outer drum needs to be cleaned since washing water flows between the inner drum and the outer drum is further avoided. Meanwhile, since no outer drum is arranged in the washing machine, or the outer drum is integrated with the housing of the washing machine, the inner drum of the washing machine can be further enlarged, to expand the washing capacity of the washing machine.

However, since the inner drum can be not only configured to accommodate washing water, but also can rotate to beat and clean clothes in the drum, therefore, how to set a water dehydrating structure and a water drainage structure applicable to the above washing machine has become a problem to be urgently solved.

In view of the above technical shortcomings, the present disclosure is hereby proposed.

SUMMARY

The objective of the present disclosure is to overcome the above shortcomings existing in the prior art, and provide a washing machine, to achieve the dual purposes of accommodating washing water and stirring clothes in an inner drum. The present disclosure further relates to an inner drum, to achieve the purpose of guiding washing water in the inner drum to converge and flow towards a water guide flow channel arranged at an inner drum bottom and improving the efficiency in discharging washing water.

To solve the technical problem and achieve the technical effect, a basic conception of the technical solution adopted in the present disclosure is as follows:

An inner drum is disclosed. Lifting ribs are provided in the inner drum and extending along a generatrix of the inner drum, each of the lifting ribs is hollow inside. A water-splashing surface of the lifting rib is provided with permeable holes to allow a hollow part of each of the lifting ribs to be communicated with an inside of the inner drum. A rear end of each of the lifting ribs is arranged to be close to an inner drum bottom, and provided with a water outlet structure.

Further, the inner drum bottom is provided with water guide flow channels which extend towards a center from a periphery of the inner drum bottom. Ends, at the peripheral of the inner drum bottom, of the water guide flow channels are corresponding to the lifting ribs one by one. Each of the lifting ribs and each of the corresponding water guide flow channels corresponding to the each of the lifting ribs are arranged in a same radial section of the inner drum. Further, the water outlet structure arranged on the rear end of the lifting rib is the permeable holes arranged on the rear end of each of the lifting ribs, and/or a notch arranged on a junction, being connected with a side wall of the inner drum of a washing machine, of the rear end of the lifting rib. The permeable holes communicate an inside of the lifting rib with the inner drum; and/or the notch communicates an inside of the lifting rib with the inner drum. Preferably, one end of each of the water guide flow channel is arranged at the periphery of the inner drum bottom in a manner of separating from the side wall of the inner drum by a gap. The notch is arranged at the junction, of the rear end of each of the corresponding lifting rib, being connected with the side wall of the inner drum of the washing machine. The notch and the gap are arranged along a same generatrix of the inner drum in a manner of being close to each other. Further preferably, the rear end of each of the lifting ribs is separated from the inner drum bottom by a gap, such that washing water in the inner drum flows to the water guide flow channel through the gap. Further, the hollow part of each of the lifting ribs is provided with a baffle plate which extends along the generatrix of the inner drum, the baffle plate divides the hollow part of the lifting rib into two parts which are independent to each other. The two parts are respectively communicated with the inner drum via the permeable holes arranged on the water-splashing surface corresponding to each of the two parts. Further, the baffle plate extends along a center line of each of the lifting ribs. The two parts which are independent to each other at two sides of the baffle plate are respectively communicated with the water outlet structure arranged on the rear end of each of the lifting ribs, such that washing water in the two parts is discharged to the corresponding water guide flow channels through the water outlet structure arranged on the rear end of each of the lifting ribs. Further, a left side surface and a right side surface of the baffle plate are both inclined surfaces which incline from the inner drum bottom to an opening of the inner drum along a direction far away from an axis of each of the lifting ribs, to guide washing water inside the lifting ribs to converge and flow towards a center of the rear end of each of the lifting ribs along the baffle plate, such that washing water directly flows into the water guide flow channels. Further, the inner drum is a conical drum with diameters being increased from the opening towards the inner drum bottom. Further, the inner drum bottom is arranged with water guide flow channels which extend towards the center from the periphery. The center of the inner drum bottom is provided with a central joint which is respectively communicated with another end of each of the water guide flow channels. A rear end of the central joint is provided with a water outlet connector which penetrates through the inner drum bottom, such that washing water in the inner drum flows to the central joint through the water guide flow channels under an effect of a centrifugal force, and then flows out of the inner drum through the water outlet connector. Further, an inner side of the inner drum bottom is provided with water-splashing ribs which protrude towards the inside of the inner drum and are symmetrically relative to the center of the bottom. Each of the water-splashing ribs extends along a radial direction of the inner drum bottom from the periphery to the center of the inner drum bottom. The water-splashing rib is hollow inside; hollow parts of the water-splashing ribs constitute the water guide flow channels. One end of each of the water guide flow channels is arranged at the periphery of the inner drum bottom and is respectively communicated with the inner drum.

The present disclosure further introduces a no-clean washing machine, and the washing machine is installed with any of the above inner drums. The inner drum is a closed container with an opening being closed by a door cover, and when the inner drum rotates at a high speed, washing water is guided to flow towards the direction to the inner drum bottom and flow to the center of the inner drum bottom along the water guide flow channel arranged on the inner drum bottom, and is discharged out of the inner drum through the water outlet connector of the central joint.

Compared with the washing machine in the prior art, the washing machine in the present disclosure has the following beneficial effects:

Via the above setting, washing water in the inner drum is guided to discharge outwards towards the water guide flow channel at the inner drum bottom by utilizing the centrifugal force generated when the inner drum rotates at a high speed. Washing water is discharged controllably when the inner drum rotates at the high speed and the inner drum accommodates water for washing when the inner drum normally rotates and washes. Further, when the washing machine executes dehydrating and/or discharging procedures and the centrifugal force generated when the inner drum rotates at a high speed acts on the washing water, after the washing water is discharged outwards automatically along the water guide flow channel, the washing water is discharged out of the washing machine along the water guide sleeve. Moreover, via setting lifting ribs on the side wall of the inner drum, when the inner drum rotates at a high speed, the washing water which flows close to the wall flows to the inside of the lifting rib under a blocking effect of the lifting rib, and under the effect of the centrifugal force, washing water flows towards the direction of the inner drum bottom along the internal chamber of the lifting rib, thereby avoiding low efficiency of water drainage caused by turbulence of the washing water.

The objective of the present disclosure is to overcome the above shortcomings existing in the prior art, and provide a washing machine, to realize the dual functions of accommodating washing water and stirring clothes of the inner drum. The present disclosure further relates to an inner drum, to realize the purpose of smoothly discharging washing water accommodated in the inner drum by utilizing the centrifugal force generated when the inner drum rotates at a high speed.

To solve the above technical problem and achieve the technical effect, a basic design concept of the technical solution adopted in the present disclosure is as follows:

An inner drum is disclosed. An inner drum bottom is arranged with water guide flow channels which extend towards a center from a periphery of the inner drum bottom. The center of the inner drum bottom is provided with a central joint which is respectively communicated with an end of each of the water guide flow channels. A rear end of the central joint is provided with a water outlet connector which penetrates through the inner drum bottom, such that washing water in the inner drum flows to the central joint through the water guide flow channels under an effect of a centrifugal force, and then flows out of the inner drum through the water outlet connector.

Further, the inner drum is a conical drum with diameters being increased from an opening towards the inner drum bottom. Further, an inner side of the inner drum bottom is provided with water-splashing ribs which protrude towards the inside of the inner drum and are symmetrically arranged relative to the center of the inner drum bottom. The water-splashing rib extends along a radial direction of the inner drum bottom from the periphery to the center of the inner drum bottom. The water-splashing rib is hollow inside; hollow parts of the water-splashing ribs constitute the water guide flow channels. One end of each of the water guide flow channels is arranged at the periphery of the inner drum bottom and is respectively communicated with the inner drum. Further, a side wall of the inner drum is provided with lifting ribs which protrude towards an inside of the inner drum. The lifting rib is hollow inside, a water-splashing surface of the lifting rib is provided with permeable holes to communicate with the inside. A rear end of the lifting rib is arranged to be close to the inner drum bottom, and provided with a water outlet structure. Preferably, the lifting rib extends along a generatrix of the side wall of the inner drum, and a left side surface and a right side surface of each of the lifting rib are respectively provided with permeable holes. Further, each of the water guide flow channels is corresponding to one lifting rib. Each the water guide flow channel and the lifting rib correspondingly extend along a same radial section of the inner drum. Preferably, a water outlet structure on the rear end of the lifting rib is set to be close to one end of the water guide flow channel correspondingly. Further, the water outlet structure arranged on the rear end of the lifting rib is the permeable holes arranged on the rear end of the lifting rib, and/or a notch arranged on a junction, being connected with the side wall of the inner drum of the washing machine, of the rear end of the lifting rib. The permeable holes communicate an inside of the lifting rib with the inner drum. And/or, the notch communicates an inside of the lifting rib with the inner drum. Preferably, the one end of each of the water guide flow channels is arranged at the periphery of the inner drum bottom in a manner of separating from the side wall of the inner drum by a certain gap. A notch is arranged at the junction, being connected with the side wall of the inner drum of the washing machine, of the rear end of the corresponding lifting rib. The notch and the gap are arranged along a same generatrix of the inner drum in a manner of being close to each other. Further preferably, the rear end of the lifting rib is separated from the inner drum bottom by a certain gap, such that washing water in the inner drum flows to the water guide flow channel through the gap. Further, the central joint is fixedly installed in the center of the inner drum bottom. The central joint includes a body which is a circular ring or a semi sphere, the body of the central joint is hollow inside to constitute a water passage chamber. The periphery of the body of the central joint is provided with a water inlet which is connected with the water guide flow channels correspondingly, to guide washing water in the water guide flow channel into the water passage chamber. Further, a rear end of the central joint is provided with a water outlet connector which is set to be coaxial with the central joint and extends backwards. The water outlet connector penetrates through the inner drum bottom, to communicate the water passage chamber with an outside of the inner drum. Preferably, the penetrating end of the water outlet connector is connected with one end part of a water guide sleeve in a plug-in manner, and another end of the water guide sleeve is communicated with a water outlet pipe of the washing machine, such that washing water flowing out of the inner drum is discharged out of the washing machine. Further, the central joint and the inner drum bottom of the washing machine are set to be integrated, and a periphery of the central joint is connected with the inner drum bottom via a smooth curved surface.

The present disclosure further introduces a no-clean washing machine, and the washing machine is installed with any of the above inner drums. The inner drum is a closed container with an opening being closed by a door cover, and when the inner drum rotates at a high speed, the washing water is guided to flow towards the direction of the inner drum bottom and flow to the center of the inner drum bottom along the water guide flow channel formed on the inner drum bottom, and is discharged out of the inner drum via the water outlet connector of the central joint.

Compared with the washing machine in the prior art, the washing machine in the present disclosure has the following beneficial effects:

Via the above setting, the washing water in the inner drum is discharged via being guided towards the water guide flow channel at the inner drum bottom by utilizing the centrifugal force generated when the inner drum rotates at a high speed, and washing water is discharged controllably when the inner drum rotates at a high speed and the inner drum accommodates water for washing when the inner drum normally rotates and washes. Further, when the washing machine executes dehydrating and/or discharging procedures and when the centrifugal force generated when the inner drum rotates at a high speed acts on the washing water, after the washing water is discharged outwards automatically along the water guide flow channel, the washing water is discharged out of the washing machine along the water guide sleeve. Moreover, via the above setting, the center tub is arranged at the center of the inner drum bottom, and further the end of each of the water guide flow channels at the periphery of the inner drum bottom is converged at the center of the inner drum, and the washing water converged to the center tub is discharged backwards out of the inner drum, to achieve the purpose of guiding the washing water converged at the periphery of the inner drum bottom to discharge outwards when the inner drum rotates at a high speed.

An object of the present disclosure is to overcome the above shortcomings existing in the prior art, and provide a washing machine, to realize dual functions of accommodating washing water and stirring clothes in the inner drum. The present disclosure further relates to a water guide sleeve, to achieve the dual effects of discharging washing water in the inner drum outwards and performing motive drive on the inner drum.

To solve the technical problem and achieve the technical effect, a basic concept of the technical solution adopted in the present invention is as follows.

A water guide sleeve is provided. A center of the inner drum bottom of the washing machine is provided with a water outlet portion which is set in a penetrating manner. A first end of the water guide sleeve is connected with the water outlet portion in a plug-in manner, to guide the washing water flowing out of the inner drum to flow to a water drainage pipe of the washing machine along the water guide sleeve. The first end of the water guide sleeve is provided with a connecting structure fixed with the inner drum bottom, and the water guide sleeve is further engaged and fixed with the rotor of the drive motor of the washing machine, such that the rotor of the drive motor drives the inner drum to rotate through the water guide sleeve.

Further, an outer side of the inner drum bottom is installed with fixedly connected a supporting piece. The supporting piece is set to be symmetrical relative to a center of the inner drum bottom. A center of the supporting piece is provided with a through hole for allowing the water outlet portion to penetrate through correspondingly. The first end of the water guide sleeve is fixedly connected with the supporting piece, and is connected with the water outlet portion in a plug-in manner. Further, the center of the supporting piece is provided with an inserting part which is correspondingly engaged and fixed with the first end of the water guide sleeve. The water outlet portion is coaxially arranged at the end part of the inserting part. The first end of the water guide sleeve connected with the supporting piece is connected with the water outlet portion in a plug-in manner. Further, the water guide sleeve extends along the axial direction of the inner drum. A rear end of the inner drum is provided with an inner drum supporting piece. The inner drum supporting piece is installed with a drive motor which is set to be coaxial with the inner drum. A center of the rotor of the drive motor is fixedly connected with a periphery of the second end of the water guide sleeve. Further, the center of the inner drum supporting piece is provided with a bearing seat with a barrel-shaped contour. The bearing seat is internally provided with at least one bearing sleeve which is set to be coaxial with the inner drum. A middle part of the water guide sleeve is installed in the bearing sleeve in a supporting manner. Preferably, a front end and a rear end of the bearing seat are respectively provided with one bearing sleeve. Further preferably, an inner diameter of the front bearing sleeve is larger than an inner diameter of the rear bearing sleeve. The water guide sleeve is provided with different axle segments which are respectively set to be corresponding to the front bearing sleeve and the rear bearing sleeve, such that the front bearing sleeve and the rear bearing sleeve respectively correspondingly fix and support different axle segments of the water guide sleeve. Further, the periphery of the water guide sleeve is further sleeved with a dynamic sealing ring. The dynamic sealing ring is arranged between the bearing seat and the supporting piece. A periphery of the dynamic sealing ring is sealed with and abutted against the front end of the bearing seat, to prevent leakage of the washing water. Further, the drive motor is arranged at the rear side of the supporting piece. The second end of the water guide sleeve in sequence penetrates through an inner stator and an outer rotor of the motor. A center of the outer rotor is provided with a spline hole which is fixed connected with the axel segment, penetrating through the spline hole, of the water guide sleeve. A periphery of the axle segment of the water guide sleeve is provided with an external spline matched with the spline hole, such that the water guide sleeve and the outer rotor are fixedly connected through the spline. Further, a second end of the water guide sleeve penetrates out of the outer rotor. The second end is communicated with the water drainage pipe of the washing machine through a water outlet structure, such that the washing water is guided out of the washing machine. Preferably, the water outlet structure includes a water flowing chamber with a sealed state. The water flowing chamber is fixedly installed on the inner drum supporting piece. An outer side of the water flowing chamber is communicated with the water outlet joint, and the inner side is communicated with the second end of the water guide sleeve. An end part of the water outlet joint is communicated with the water drainage pipe of the washing machine, such that the washing water flowing into the water flowing chamber from the water guide sleeve flows out of the washing machine from the water drainage pipe through the water outlet joint. Further, multiple axle segments, with outer circumference diameters being gradually decreased, are arranged on the water guide sleeve from the first end to the second end.

A no-clean washing machine is provided. An inner drum of the washing machine is a container with an opening being closed after being fastened by a door cover. When the inner drum rotates at a high speed, the washing water is guided to flow towards the inner drum bottom and flow to the center of the inner drum bottom along a water guide flow channel formed on the inner drum bottom, and is discharged out of the inner drum through a water outlet portion of a center sub. The water outlet portion at the rear end of the inner drum bottom is in communication with the first end of the above water guide sleeve in a plug-in manner, to guide the washing water to the water drainage pipe of the washing machine through the water guide sleeve and to discharge.

Compared with a washing machine in the prior art, the washing machine in the present invention has the following beneficial effects.

Through the above arrangement, the washing water in the inner drum is guided to the water guide flow channel at the inner drum bottom and is discharged outwards by utilizing the centrifugal force generated by a high rotating speed of the inner drum. Dual effects are achieved, washing water is discharged controllably when the inner drum rotates at a high speed and washing water stored in the inner drum is for washing when the inner drum performs washing at a normal rotation. Further, when the washing machine executes dehydrating and/or discharging procedures, the centrifugal force generated by high rotating speed of the inner drum acts on the washing water to be discharged outwards automatically along the water guide flow channel, and to be discharged out of the washing machine along the water guide sleeve. Moreover, through setting a water guide sleeve at the rear side of the washing machine, the central through hole of the water guide sleeve constitutes a channel for allowing washing water to flow out of the inner drum to discharge outwards, to realize the purpose of smoothly discharging washing water out of the inner drum along the water guide sleeve by utilizing the centrifugal force. The water guide sleeve constitutes a connecting shaft between the inner drum and the drive motor, such that the drive motor realizes the purposes of performing power transmission and driving the inner drum to rotate by utilizing the water guide sleeve.

The objective of the present disclosure is to overcome the above shortcomings existing in the prior art, and provide a washing machine, to realize dual functions of accommodating washing water and stirring clothes in the inner drum. The present disclosure further relates to a water outlet structure of the washing machine, to achieve the purpose of guiding the washing water, guided by the water guide sleeve which rotates together with the inner drum, to discharge out of the water drainage pipe of the washing machine.

To solve the technical problem and achieve the technical effect, a basic design concept of the technical solution adopted in the present invention is as follows:

A water outlet structure of a washing machine is provided. a rear side of an inner drum supporting piece of the washing machine is fixedly installed with a water flowing chamber with a sealed state. The water flowing chamber is provided with a water outlet joint which is fixed with the inner drum supporting piece. The end part of the water guide sleeve which rotates along with the inner drum is stuck into the water flowing chamber, to discharge out the washing water which flows out of the inner drum along the water guide sleeve.

Further, the rear side of the inner drum supporting piece of the washing machine is fixedly installed with a fixed shelf. The fixed shelf is fixedly installed with a water outlet joint, and the fixed shelf is provided with a sealed water flowing chamber which is communicated with the water outlet joint. The end part of the water guide sleeve which rotates along with the inner drum is stuck into the water flowing chamber, and in a dynamic sealing state on a penetrating connecting point. The washing water flowing out of the inner drum along the water guide sleeve is guided to the water flowing chamber, and then flows out through the water outlet joint. Further, a center of the fixed shelf is provided with a through hole which is set to be coaxial with the inner drum. The through hole is installed with a mounting sleeve with a barrel-shaped contour which is set to be coaxial with the inner drum. A front side of the mounting sleeve is in connected with the end part of the water guide sleeve in a sealing and plug-in manner, and a rear side is in sealing connection with the water outlet joint, such that a hollow part of the mounting sleeve encircles the closed water flowing chamber. Further, a bearing sleeve and a dynamic sealing sleeve are arranged the mounting sleeve from front to back in sequence, wherein the bearing sleeve is used for positioning support on the water guide sleeve, and the dynamic sealing sleeve seals the water guide sleeve. The bearing sleeve and the dynamic sealing sleeve are correspondingly sleeved on a periphery of the water guide sleeve, and a periphery of the dynamic sealing sleeve is in sealed fit and contact with an inner wall of the mounting sleeve. Further, the water outlet joint includes a flange plate which covers a rear side of the mounting sleeve. The flange plate is in sealed connection with the rear side of the mounting sleeve. A center of the flange plate is provided with a water outlet which is set to be coaxial with the inner drum, and the water outlet is correspondingly communicated with the water flowing chamber. Preferably, the water outlet is a barrel-shaped opening which protrudes and extends backwards from the flange plate. Further preferably, a front side of the flange plate is provided with a ring of limit ribs which protrude towards an inside of the mounting sleeve. An end part of the limit rib is abutted against the sealing sleeve. The outer circumference diameter of the limit rib is set to be equal to an inner circumference diameter of the mounting sleeve, such that the limit rib is in fit and contact with the inner wall of the mounting sleeve. Further, two sides of a mounting flange plate are respectively in corresponding fit and contact with the flange plate and the fixed shelf, and the mounting flange plate is fixedly connected with the flange plate and the fixed piece respectively through a bolt. Preferably, an outer circumference diameter of the flange plate is larger than an inner circumference diameter of the mounting sleeve, and is smaller than an outer circumference diameter of the flange plate. Further, the dynamic sealing sleeve is a sealing ring with a C-shaped cross section, and two ends of the dynamic sealing sleeve are respectively limited with and abutted against the flange plate of the water outlet joint and the bearing sleeve. Further, the fixed shelf is a strip plate which extends vertically and which is symmetrical to the axis of the inner drum. Two ends of the fixed shelf are respectively bent towards the inner drum, and bending parts are respectively fixedly connected with the rear side of the inner drum supporting piece. The mounting sleeve is arranged in the center of the fixed shelf and is set to be coaxial with a shaft of the inner drum. Further, the rear side of the inner drum supporting piece is fixedly installed with a drive motor which is set to be coaxial with the inner drum. The drive motor is arranged between the fixed shelf and the inner drum supporting piece, and the drive motor is separated from the fixed shelf and the inner drum supporting piece of respectively by a certain gap. Preferably, the water guide sleeve penetrates through the drive motor and is in fixed engagement with a rotor of the drive motor. The periphery of the water guide sleeve is sleeved with a limit sleeve. The limit sleeve is arranged between the rotor and the mounting sleeve, and an outer circumference diameter of the limit sleeve is larger than the diameter of the bearing sleeve, to prevent the bearing sleeve from falling off from the mounting sleeve.

A no-clean washing machine is provided by the present disclosure. The inner drum of the washing machine is a container with an opening and is closed after being fastened by a door cover. When the inner drum rotates at a high speed, the washing water is guided to flow towards the inner drum bottom and flow to the center of the inner drum bottom along a water guide flow channel formed on the inner drum bottom, and is discharged out of the inner drum through a water outlet portion of a center sub. The water outlet portion at the rear end of the inner drum bottom is in communication with the first end of the water guide sleeve in a plug-in manner, and the second end of the water guide sleeve is communicated with the water drainage pipe of the washing machine through any of the above water outlet structures.

Compared with a washing machine in the prior art, the washing machine in the present invention has the following beneficial effects:

Through the above arrangement, the washing water in the inner drum is guided to the water guide flow channel formed at the inner drum bottom and is discharged outwards by utilizing the centrifugal force generated by a high rotating speed of the inner drum. Dual effects are achieved, washing water is discharged controllably when the inner drum rotates at a high speed and washing water stored in the inner drum is for washing when the inner drum performs washing at a normal rotation. Further, when the washing machine executes dehydrating and/or discharging procedures, the centrifugal force generated by a high rotating speed of the inner drum acts on the washing water to be discharged outwards automatically along the water guide flow channel, and to be discharged out of the washing machine along the water guide sleeve. Moreover, through setting a water flowing chamber at the rear side of the washing machine, the water guide sleeve, which guides washing water to flow outwards and rotates together with the inner drum, is in dynamic sealed connection with the water flowing chamber, and then is in direct connection with the water drainage pipe of the washing machine in a plug-in manner. Thereby it is avoided to be in nonsynchronous rotation and incapability of abutting caused by direct abutment between the water guide sleeve and the water drainage pipe, and further realizing the purpose of smoothly discharging the washing water guided by the water guide sleeve out of the washing machine.

To make the concept of the technical solution of the present disclosure clearer, and to further facilitate the beneficial effects brought about by the present disclosure, a detailed description is given below on part of the specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for person having ordinary skill in the art; other drawings can be obtained based on these drawings without any creative effort. In the drawings.

Figure 1:
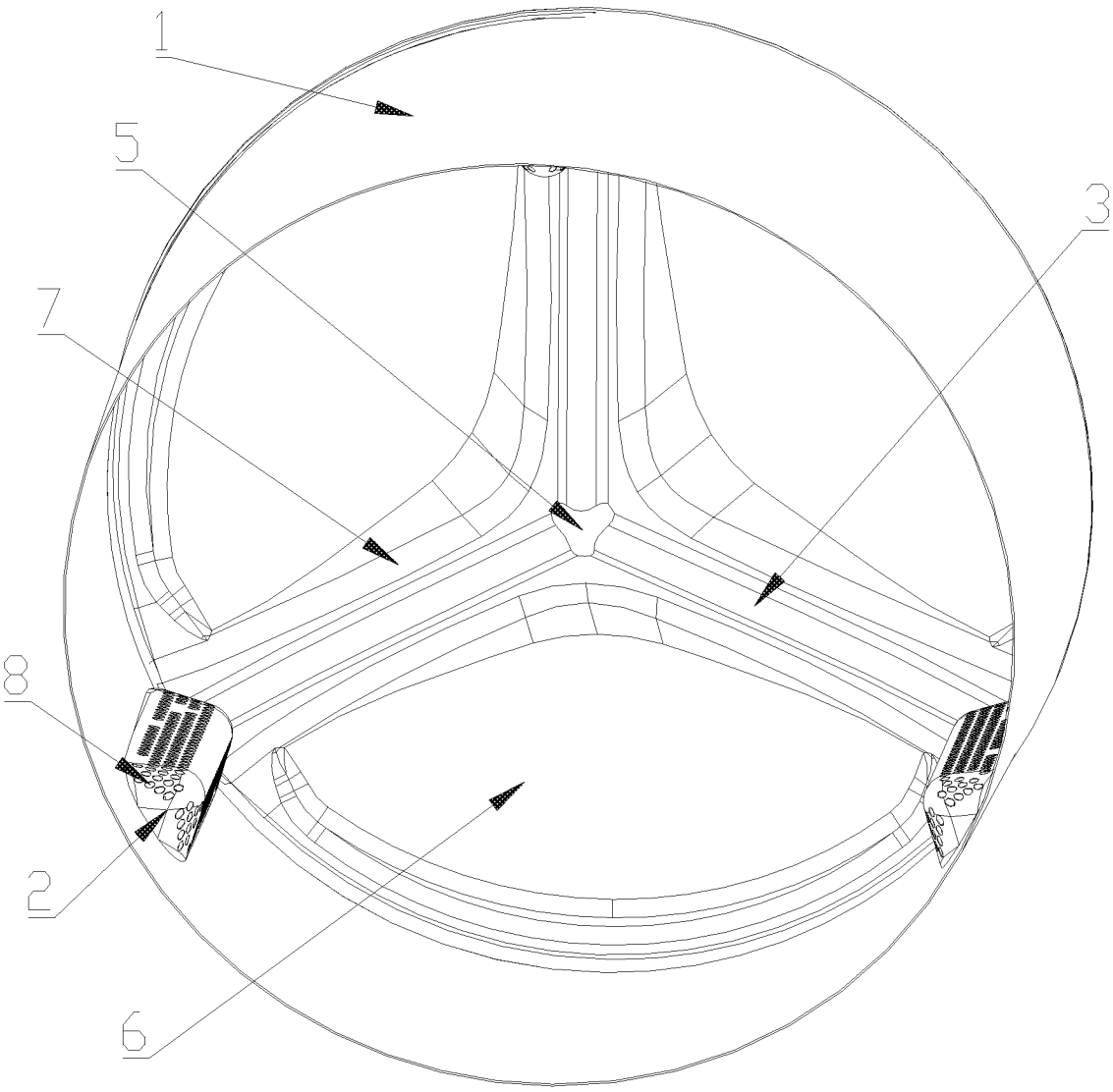
FIG. 1 is a structural schematic diagram of an inner drum of a washing machine in an embodiment of the present disclosure.

Reference numerals in the figures: 1, inner drum, 2, lifting rib, 3, water guide flow channel, 4, inner drum supporting piece, 5, central joint, 6, inner drum bottom, 7, water-splashing rib, 8, permeable hole, 9, notch, 10, water passage chamber, 11, water guide sleeve, 12, drive motor, 13, outer rotor, 14, inner stator, 15, bearing seat, 16, front bearing sleeve, 17, rear bearing sleeve, 18, motive sealing ring, 19, water flowing chamber, 20, supporting piece, 21, water outlet joint, 22, fixed shelf, 23, installation sleeve, 24, bearing sleeve, 25, motive sealing sleeve, 26, flange plate, 27, mounting flange plate, 28, limit rib, 29, water outlet, 30, limit sleeve, 31, baffle plate, 500, body of a center tub, 501, water outlet connector.

It should be noted that, these drawings and text descriptions are not aiming at limiting a conception range of the present disclosure in any form, but to describe concepts of the present disclosure for those skilled in the art with a reference to specific embodiments.

DETAILED DESCRIPTION OF THE EMBODIMENTS

In order to make the object, technical solutions and advantages of the embodiments in the present disclosure clearer, a clear and complete description will be given below on technical solutions in the embodiments in combination with accompanying drawings in the embodiments of the present disclosure. The following embodiments are used for describing the present disclosure, rather than for limiting the scope of the present disclosure.

In the description of the present disclosure, it should be noted that, the orientation or positional relationship indicated by such terms as "up", "down", "front", "rear", "left", "right", "vertical", "horizontal", "inner" and "outer" is the orientation or positional relationship based on the accompanying drawings. Such terms are merely for the convenience of description of the present disclosure and simplified description, rather than indicating or implying that the device or element referred to must be located in a certain orientation or must be constructed or operated in a certain orientation, thereby the terms cannot be understood as a limitation to the present disclosure.

In the description of the present disclosure, it should be noted that, unless otherwise stipulated and defined definitely, such terms as "installed", "connected" and "in connection" should be understood in their broad sense, e.g., the connection can be a fixed connection, a detachable connection or an integral connection; can be mechanical connection or electrical connection; and can be direct connection or can be indirect connection through an intermediate. For those skilled in the art, the specific meanings of the above terms in the present disclosure can be understood according to specific conditions.

As shown in FIG. 1 to FIG. 9, an embodiment of the present disclosure introduces a washing machine. The washing machine includes a housing which is internally provided with an inner drum 1. An axis of the inner drum 1 extends horizontally or is set to be inclined downwards gradually from front to back. A front end of the inner drum 1 is an opening of the inner drum, and a rear end of the inner drum 1 is an inner drum bottom which is set to be sealed. A drum wall of the inner drum 1 is arranged without through holes, such that an inside of the inner drum 1 is formed as a sealed container which is only open in the front. Meanwhile, the front of the housing of the washing machine is installed with a door cover which can be open towards an outside, to close the opening of the inner drum when the door cover is closed and to deliver clothes through the opening of the inner drum to the inner drum 1 after the door cover is opened. The rear end of the inner drum 1 is installed in the housing of the washing machine via an inner drum supporting piece. The supporting piece is set to be coaxial with the rear end of the inner drum 1; an upper end and a lower end of the inner drum supporting piece are respectively bent towards a direction of the front end of the inner drum 1. An upper bending part and a lower bending part which are formed by bending of the inner drum supporting piece at least extend to a middle part of the inner drum 1. The upper bending part and the lower bending part are respectively connected with the housing of the washing machine via a damping spring and a damping supporting rod, such that the inner drum supporting piece can be installed in the housing of the washing machine in a vibrating manner. Meanwhile, a center of the inner drum bottom is set to be coaxial with a motor shaft of a drive motor of the washing machine, to drive the inner drum to rotate, and the inner drum and the drive motor are both fixedly installed on the inner drum supporting piece. Preferably, the inner drum bottom and the drive motor are respectively arranged at two sides of the inner drum supporting piece. The drive motor is fixedly connected with the inner drum supporting piece; the motor shaft of the drive motor penetrates through the inner drum supporting piece via a bearing and is coaxially fixedly connected with the inner drum bottom. The motor shaft can rotate relative to the inner drum supporting piece, such that the inner drum 1 and the drive motor can be installed on the inner drum supporting piece, and the inner drum 1 can rotate independently under an effect of the drive motor, to wash clothes inside the inner drum.

In addition, the washing machine in the embodiment of the present disclosure can be any washing machine in the prior art in which the inner drum constitutes a sealed container after the door cover closes the opening of the inner drum, such that when the washing machine performs a dehydrating procedure, the inner drum is controlled to rotate at a high speed, to discharge water flow departing from clothes in the inner drum out of the inner drum smoothly, and further achieve the purpose that a washing machine with a holeless inner drum can normally execute a dehydrating procedure. Therefore, the washing machine in the embodiment of the present disclosure is not limited to the structure in the drawings. For example, an existing ordinary washing machine can also be adopted, and an inner drum of the existing ordinary washing machine only needs to be with no dehydrating holes and be a sealed container formed after the door cover closes the opening of the inner drum. Of course, an inner drum cover can also be separately set at the opening of the inner drum of the washing machine, the inner drum cover can be separately operated without need a door cover, and the opening of the inner drum is sealed and closed with the inner drum cover. Meanwhile, the washing machine in the embodiment of the present disclosure can also be applicable to a washing machine with an opening at a top, a clothes delivery opening is set on the side wall of the inner drum, and a door body which can be opened and closed towards the outside in an overturning manner and which corresponds to the sealed clothes delivery opening is set on the side wall of the inner drum, to locate to the corresponding position after the inner drum stops rotating, such that the user can correspondingly open the door body, and deliver or take out clothes from the clothes delivery opening to the inner drum of the washing machine.

Meanwhile, since the inner drum is set to be a sealed container for washing after the door cover is fastened, clothes only contact with washing water in the sealed inner drum in the washing process, thereby avoiding polluted clothes caused by entrance of washing water between the inner drum and the outer drum into the inner drum, greatly improving washing cleanliness of the washing machine, and avoiding incomplete cleaning of clothes in the washing machine caused by pollution of the space between the inner drum and the outer drum by washing water.

An embodiment of the present disclosure introduces a no-clean washing machine. The inner drum 1 of the washing machine is the sealed container after the opening of the inner drum is fastened by the door cover. The inner drum bottom is arranged with water guide flow channels which extend to a center from a periphery of the bottom. The center of the inner drum bottom is provided with a central joint which is respectively communicated with ends of each of the water guide flow channels. A rear end of the central joint is provided with a water outlet connector which penetrates through the inner drum bottom. The water outlet connector is communicated with a first end of a water guide sleeve. A second end of the water guide sleeve penetrates through the drive motor and is communicated with a water flowing chamber which is fixedly installed on the inner drum supporting piece. A water outlet arranged on the water flowing chamber is communicated with a water drainage pipe of the washing machine, such that when the inner drum rotates at a high speed, washing water in the inner drum is guided to the inner drum bottom, flows out of the inner drum through the ends of each of the water guide flow channels at the periphery of the inner drum bottom, and is discharged along the water guide sleeve.

Meanwhile, in an embodiment of the present disclosure, a suction pump is arranged on the water drainage pipe of the washing machine. When working, the suction pump acts on a communicating part between the water guide flow channel and the inner drum through a pipeline, so as to form a negative pressure at a communicating end of the water guide flow channel. And washing water in the inner drum flows out along the water guide flow channel, the central joint, the water guide sleeve, and the water drainage pipe, to realize the purpose of providing a flowing power to water flow discharged by the washing machine.

In an embodiment of the present disclosure, in order to realize the convergence and flow of washing water in the inner drum towards the inner drum bottom under the action of centrifugal force, the inner drum is set as a conical cylinder which gradually expands its diameter from front to back, so that the inner drum bottom is the big mouth end of the inner cylinder. When the inner drum rotates at high speed, the washing water in the inner drum adheres to the side wall of the inner drum under the action of centrifugal force, and converges and flows along a cone wall to the inner drum bottom.

By the above setting, the washing water in the inner drum is discharged by being guided towards the water guide flow channel on the inner drum bottom by utilizing the centrifugal force generated when the inner drum rotates at a high speed. Washing water is discharged controllably when the inner drum rotates at a high speed, and the inner drum accommodates water for washing when the inner drum normally rotates and washes. Further, when the washing machine executes dehydrating and/or discharging procedures and when the centrifugal force generated when the inner drum rotates at a high speed acts on the washing water, after the washing water is discharged outwards automatically along the water guide flow channel, the washing water is discharged out of the washing machine along the water guide sleeve.

Embodiment 1

As shown in FIG. 1 to FIG. 9, the present embodiment introduces an inner drum applicable to the no-clean washing machine of the present disclosure. The inner drum bottom 6 is arranged with water guide flow channels 3 which extend to the center from the periphery of the bottom. The center of the inner drum bottom 6 is provided with a central joint 5 which is respectively communicated with an end of each of the water guide flow channels 3. A rear end of the central joint 5 is provided with a water outlet connector 501 which penetrates through the inner drum bottom 6, such that washing water in the inner drum 1 flows to the central joint 5 through the water guide flow channels 3 under an effect of a centrifugal force and then flows out of the inner drum 1 through the water outlet connector 501.

Via the above setting, the central joint is arranged at the center of the inner drum bottom, so as to gather washing water from the periphery to the center of the inner drum bottom of the inner drum bottom through the water guide flow channels, and the washing water converged to the central joint is discharged backwards out of the inner drum, thereby achieving the purpose of guiding the washing water converged at the periphery of the inner drum bottom to be discharged when the inner drum rotates at a high speed.

Figure 2:
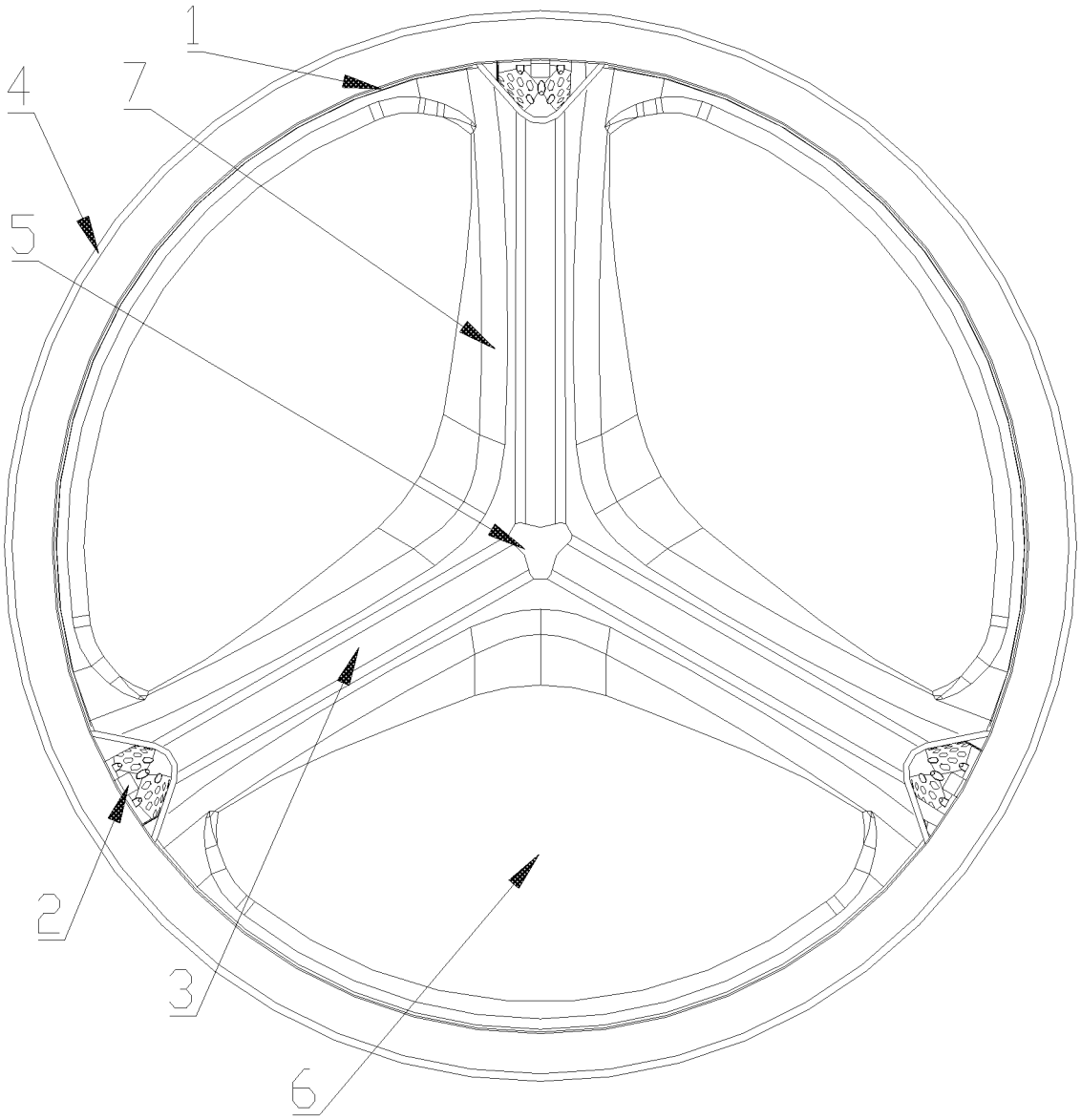
FIG. 2 is an installation structural schematic diagram of a washing machine in an embodiment of the present disclosure.

As shown in FIG. 1 and FIG. 2, in the present embodiment, the inner drum 1 is a conical drum with a diameter being increased from the opening to the inner drum bottom 6, so as to ensure that the washing water in the inner drum 1 converges and flows towards the inner drum bottom with a large diameter under the effect of the centrifugal force when the washing water flows adherence to the wall.

In the present embodiment, an inner side of the inner drum bottom 6 is provided with water-splashing ribs 7 which protrude towards the inside of the inner drum and are symmetrically arranged relative to the center of the inner drum bottom. The water-splashing rib 7 extends along a radial direction of the inner drum bottom 6 from the periphery of the inner drum bottom 6 to the center. The water-splashing rib 7 is hollow inside; a hollow part of the water-splashing rib constitutes the water guide flow channel 3. One end of each of the water guide flow channels 3 is arranged at the periphery of the inner drum bottom 6 and is respectively communicated with the inner drum 1. Therefore, the water guide flow channel is set to be hidden inside the water-splashing rib, and the water-splashing rib constituting the water guide flow channel protrudes inwards of the inner drum, when the inner drum rotates, clothes and washing water accommodated in the drum are stirred, to improve the washing effect.

Figure 3:
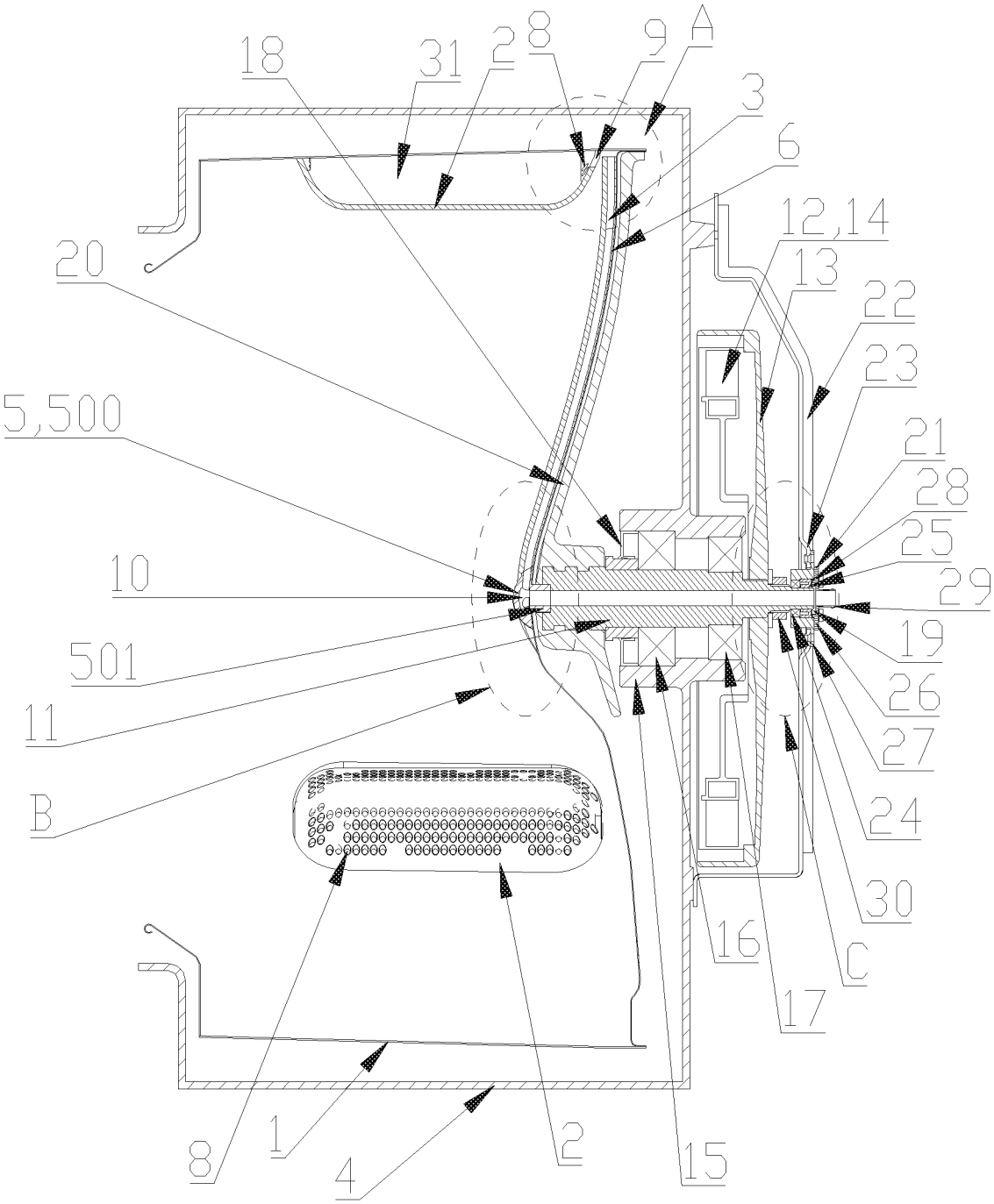
FIG. 3 is a structural schematic diagram of a cross section of a washing machine in an embodiment of the present disclosure.
Figure 4:
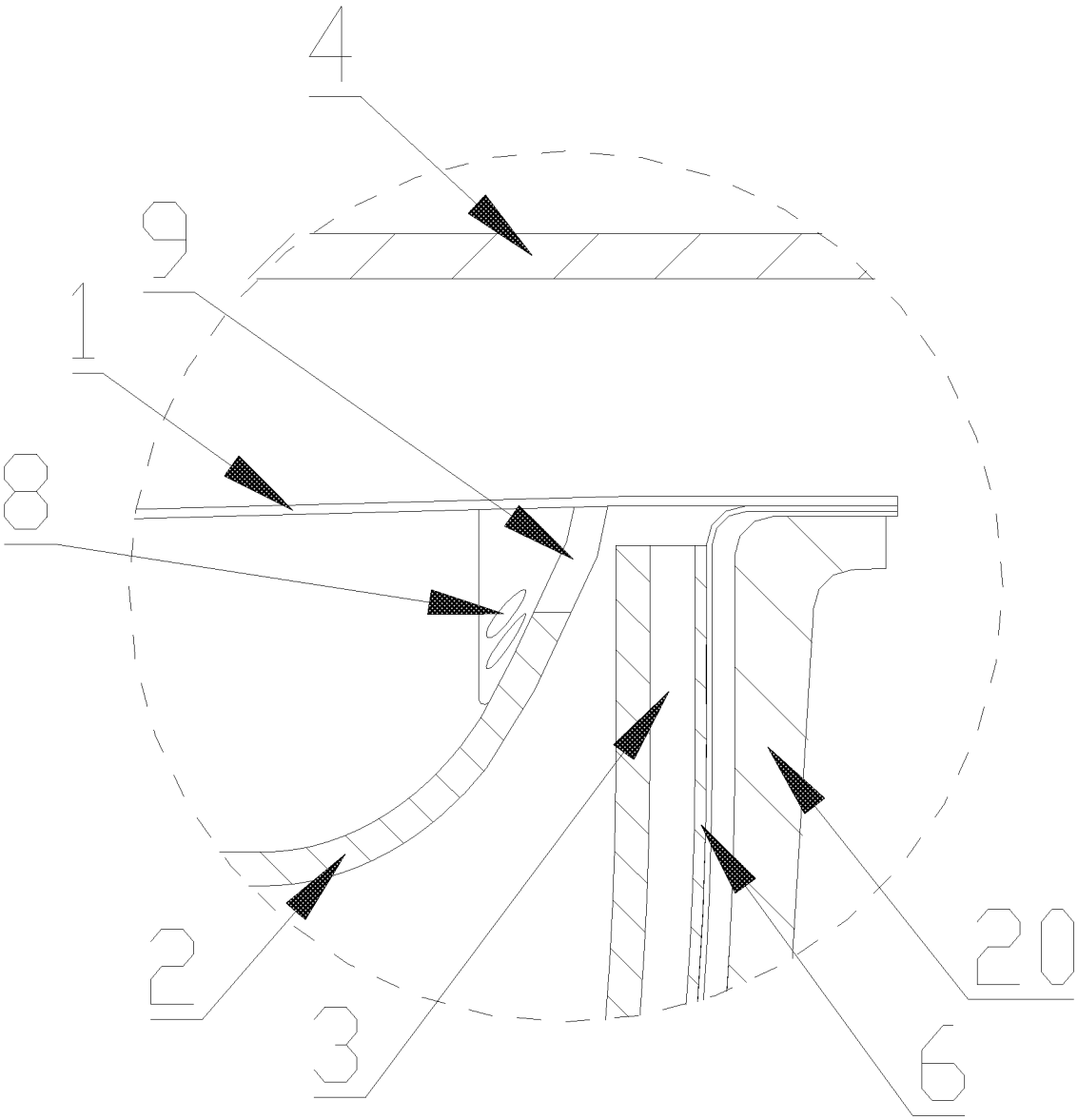
FIG. 4 is a schematic diagram of an enlarged structure of part A in FIG. 3 in an embodiment of the present disclosure.

As shown in FIG. 3 and FIG. 4 in the present embodiment, the side wall of the inner drum 1 is provided with lifting ribs 2 which protrude towards the inside of the inner drum, the lifting rib 2 is hollow inside. The water-splashing surface of each of the lifting ribs 2 is provided with permeable holes 8 to allow a hollow part of each of the lifting ribs to be communicated with the inside of the inner drum. A rear end of each of the lifting ribs 2 is set to be close to the inner drum bottom 6, and is provided with a water outlet structure which communicates the inside with the inner drum 1. Preferably, each of the lifting ribs 2 extends along a generatrix of the side wall of the inner drum 1, and a left side surface and a right side surface of each of the lifting rib 2 are respectively arranged with the permeable holes 8. Via setting the lifting ribs on the side wall of the inner drum, when the inner drum rotates at a high speed, washing water which flows adherence to the side wall flows into the inside of the lifting ribs under a blocking effect of the lifting ribs, and washing water flows towards the inner drum bottom along an internal chamber of each of the lifting ribs under the effect of the centrifugal force, thereby avoiding low efficiency of water drainage caused by turbulence of washing water.

As shown in FIG. 1 to FIG. 3, in the present embodiment, each of the water guide flow channels 3 is corresponding to a lifting rib 2, and each of the water guide flow channels 3 and each of the lifting ribs 2 correspondingly extend along a same radial section of the inner drum. Preferably, a water outlet structure on the rear end of each of the lifting ribs 2 is set to be close to one end of the water guide flow channel 3 correspondingly. Via respectively arranging the lifting rib with each of the water guide flow channels correspondingly, washing water which flows to the inner drum bottom under the blocking effect of the lifting ribs directly flows to the water guide flow channel correspondingly. Further, each of the lifting ribs and each of the water guide flow channels are in one-to-one correspondence, which forms completely a water drainage channel, thereby improving water drainage flow rate and efficiency.

Figure 8:
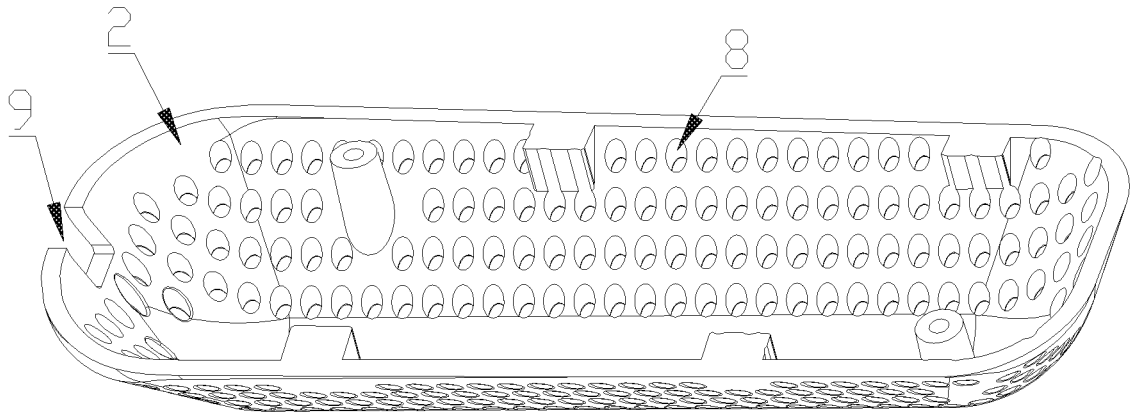
FIG. 8 is a structural schematic diagram of a lifting rib in an embodiment of the present disclosure.
Figure 9:
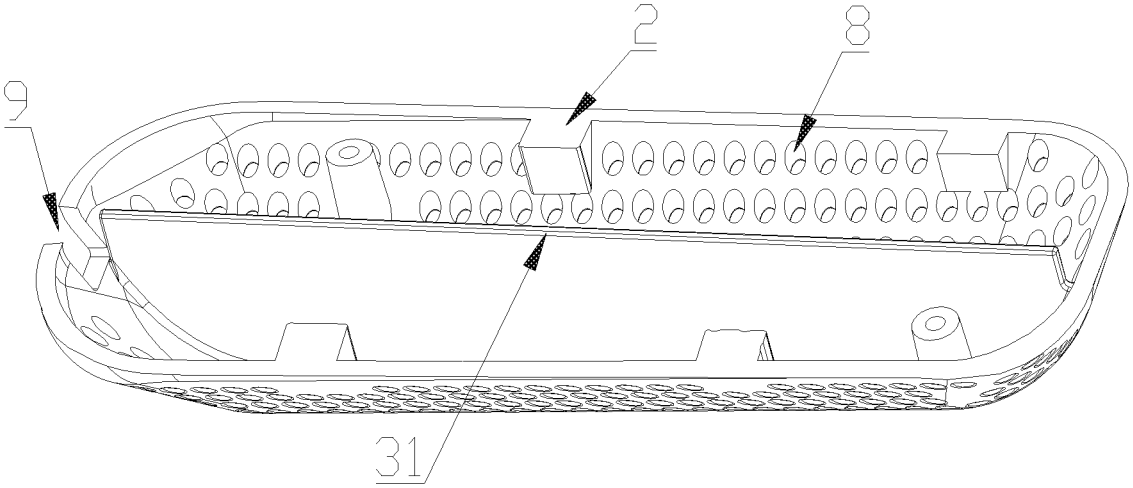
FIG. 9 is a structural schematic diagram of a lifting rib in another embodiment of the present disclosure.

As shown in FIG. 8 and FIG. 9 in the present embodiment, the water outlet structure arranged on the rear end of each of the lifting ribs 2 is the permeable holes 8 arranged on the rear end of each of the lifting ribs 2, and/or a notch 9 arranged on a junction, being connected with a side wall of the inner drum 1 of the washing machine, of the rear end of each of the lifting ribs 2. Insides of each of the lifting rib 2 are communicated with the inner drum 1 via the permeable holes 8 and/or the notch 9. Preferably, one end of each of the water guide flow channels 3 is arranged at the periphery of the inner drum bottom 6 in a manner of separating from the side wall of the inner drum 1 by a certain gap. The notch 9 is arranged at the junction, being connected with the side wall of the inner drum of the washing machine, of the rear end of the corresponding lifting rib 2. The notch 9 and the gap are arranged along a same generatrix of the inner drum 1 in a manner of being close to each other. Further preferably, the rear end of each of the lifting ribs 2 is separated from the inner drum bottom 6 by a certain gap, such that washing water in the inner drum flows into the water guide flow channel through the gap.

Figure 5:
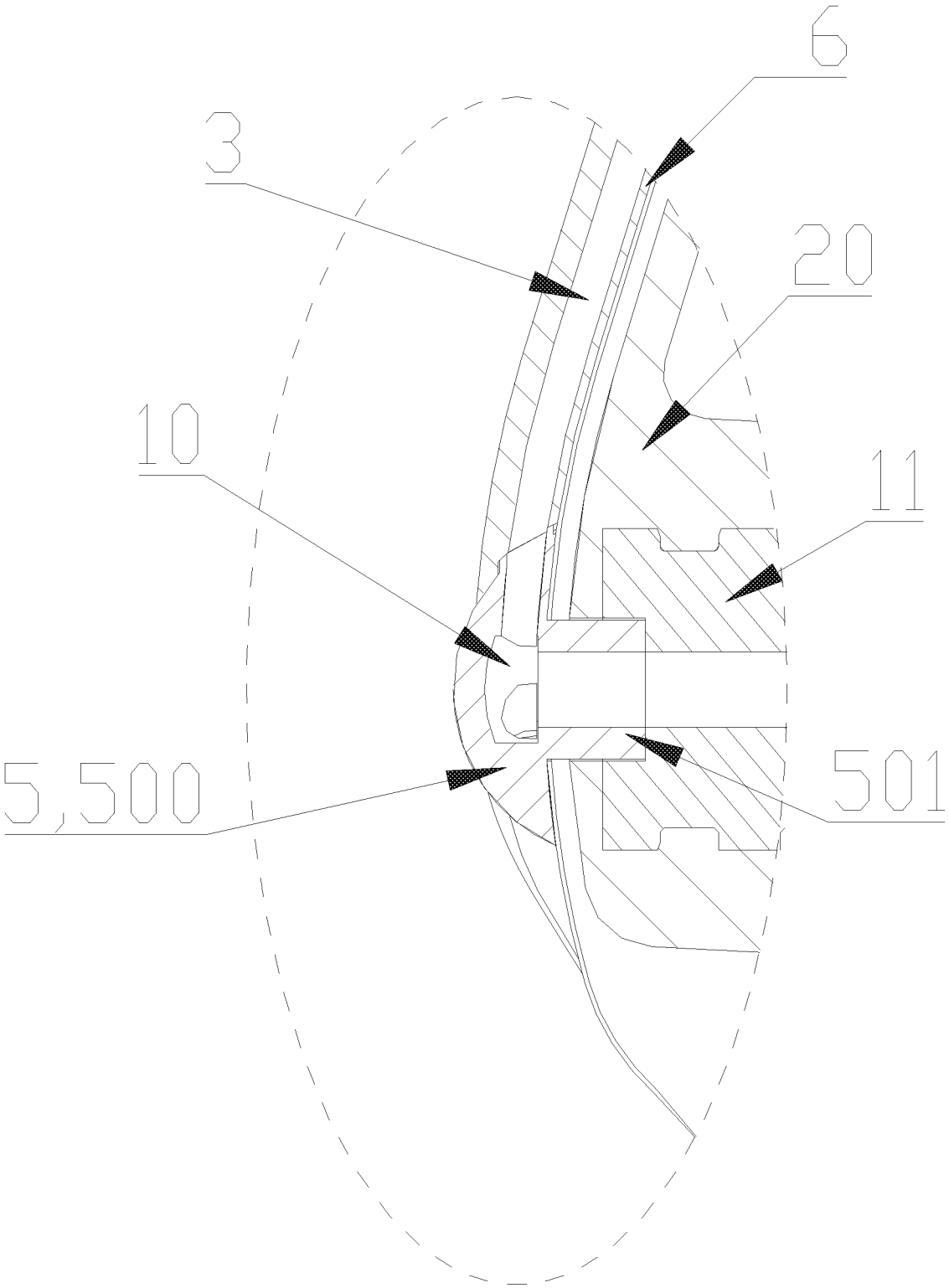
FIG. 5 is a schematic diagram of an enlarged structure of part B in FIG. 3 in an embodiment of the present disclosure.

As shown in FIG. 3 and FIG. 5, in the present embodiment, the central joint 5 is fixedly installed in the center of the inner drum bottom 6. The central joint 5 includes a body 500 which is a circular ring or a semi sphere, the body 500 of the central joint is hollow inside to constitute a water passage chamber 10. A periphery of the body 500 of the central joint is provided with a water inlet which is connected with the water guide flow channels 3 correspondingly, to guide washing water in the water guide flow channels 3 into the water passage chamber 10.

In the present embodiment, a rear end of the central joint 5 is provided with a water outlet connector 501 which is set to be coaxially with the central joint and extends backwards. The water outlet connector 501 penetrates through the inner drum bottom 6, to communicate the water passage chamber 10 with an outside of the inner drum 1. Preferably, a penetrating end of the water outlet connector 501 is connected with one end part of a water guide sleeve 11 in a plug-in manner, and another end of the water guide sleeve 11 is communicated with a water outlet pipe of the washing machine, to discharge washing water flowing out of the inner drum to an outside of the washing machine.

In the present embodiment, the central joint 5 and the inner drum bottom 6 of the washing machine are set to be integrated, and a periphery of the central joint 5 is connected with the inner drum bottom 6 via a smooth curved surface.

Preferably, the central joint 5 is fixedly connected with an supporting piece 20 arranged at the rear side of the inner drum 1, the center of the inner drum bottom 6 is provided with a through-hole which allows the central joint 5 to penetrate through, such that when the supporting piece 20 is correspondingly assembled at the rear side of the inner drum bottom 6, the central joint 5 penetrates through the inner drum 1 through the through-hole, thereby simplifying assembly steps, and improving assembly efficiency. Further preferably, the body 500 of the central joint is fixedly connected with the water outlet connector 501 in a detachable manner, and the water outlet connector 501 and the supporting piece 20 are fixedly connected or integrated, such that after the supporting piece 20 is correspondingly assembled in the inner drum bottom 6, the body 500 of the central joint is correspondingly fixed with the water outlet structure 501 at the inner side of the inner drum bottom 6, thereby not only realizing assembly of the central joint and each of the water guide flow channels, but also ensuring installation of the supporting piece and avoiding separation of the supporting piece from the inner drum bottom.

Embodiment 2

As shown in FIG. 1 to FIG. 9, the present embodiment is directed to a water guide sleeve. The center of the inner drum 6 of the washing machine is provided with a water outlet portion 501 which is set in a penetrating manner. A first end of the water guide sleeve 11 is correspondingly connected with the water outlet portion 501 in a plug-in manner, to guide the washing water flowing out of the inner drum 1 to flow to the water drainage pipe of the washing machine through the water guide sleeve 11. The first end of the water guide sleeve 11 is provided with a connecting structure fixed with the inner drum bottom 6. The water guide sleeve 11 is further engaged and fixed with the outer rotor 13 of the drive motor 12 of the washing machine, such that the outer rotor of the drive motor drives the inner drum 1 to rotate via the water guide sleeve 11.

Through setting a water guide sleeve at the rear side of the washing machine, the central through hole of the water guide sleeve constitutes a channel which allows washing water flowing out of the inner drum to discharge outwards, to realize the purpose of smoothly discharging washing water in the inner drum along the water guide sleeve by utilizing the centrifugal force. Moreover, the water guide sleeve is acted as a connecting shaft between the inner drum and the drive motor, such that the drive motor realizes the purposes of performing power transmission and driving the inner drum to rotate by utilizing the water guide sleeve.

Figure 7:
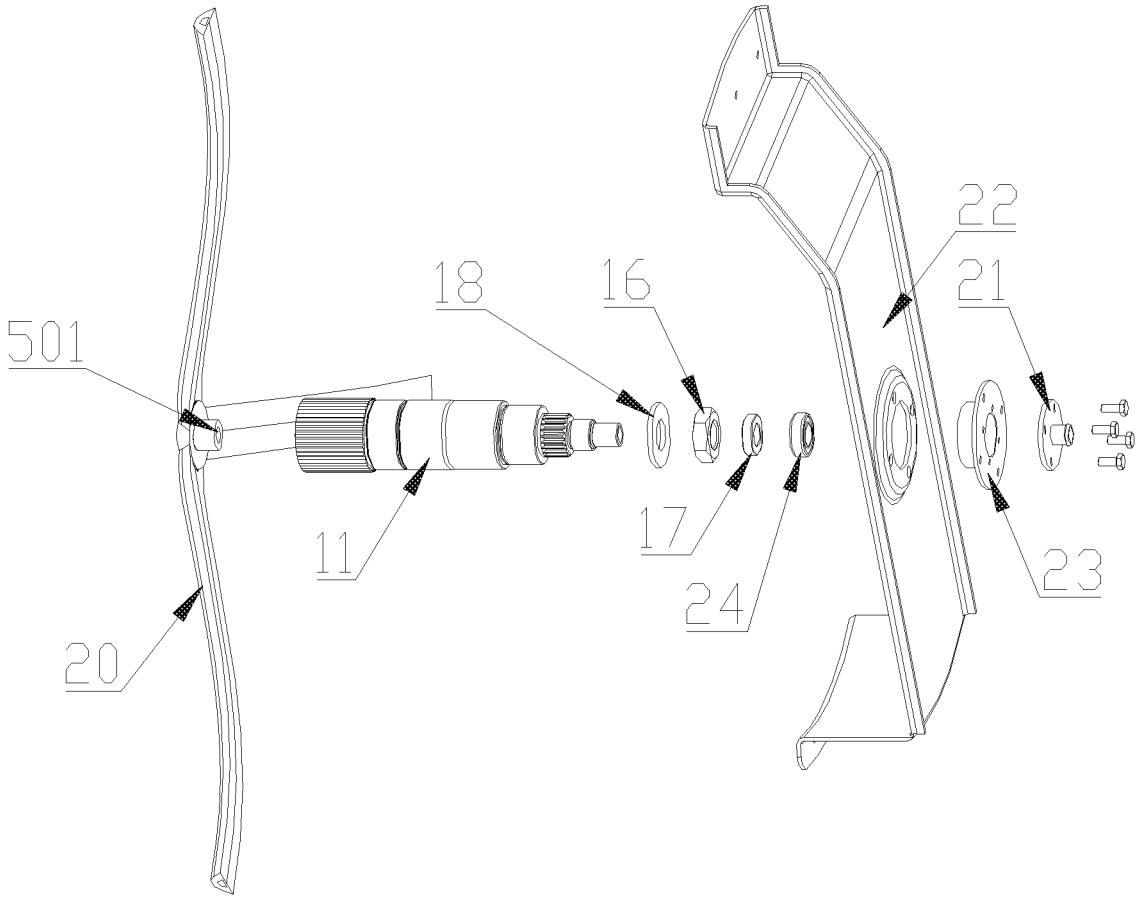
FIG. 7 is an exploded structural schematic diagram of the installation part of a water guide sleeve in an embodiment of the present disclosure.

As shown in FIG. 7, in the present embodiment, the outer side of the inner drum bottom 6 is fixedly connected with a supporting piece 20. The supporting piece 20 is set to be symmetrical relative to the center of the inner drum bottom 6, and the center of the supporting piece 20 is provided with a through hole which allows the water outlet portion 501 to penetrate through correspondingly. The first end of the water guide sleeve 11 is fixedly connected with the supporting piece 20, and is correspondingly connected with the water outlet portion 501 in a plug-in manner. By the fixed connection between the water guide sleeve and the supporting piece, the drive acting force of the drive motor is directly transferred to the supporting piece by utilizing a water guide sleeve, and drives the inner drum to rotate together through a supporting piece.

In the present embodiment, the center of the supporting piece 20 is provided with an inserting part which is correspondingly engaged and fixed with the first end of the water guide sleeve 11. The water outlet portion 501 is coaxially arranged at the end part of the inserting part, and the first end of the water guide sleeve 11 connected with the supporting piece 20 is correspondingly connected with the water outlet portion 501 in a plug-in manner. Preferably, the inserting part is a spline groove which is in corresponding connection and engagement with the first end of the water guide sleeve. The periphery of the first end of the water guide sleeve is provided with an external spline. The external spline is in engagement and connection with the spline set in the circumference of the spline groove, such that the water guide sleeve drives the inner drum to rotate through the supporting piece.

In the present embodiment, the water guide sleeve 11 extends along an axial direction of the inner drum. The rear end of the inner drum 1 is provided with an inner drum supporting piece 4. The inner drum supporting piece 4 is installed with a drive motor 12 which is set to be coaxial with the inner drum 1. The center of the outer rotor 13 of the drive motor 12 is fixedly connected with a periphery of a second end of the water guide sleeve 11.

As shown in FIG. 3, in the present embodiment, the center of the inner drum supporting piece 4 is provided with a bearing seat 15 with a barrel-shaped contour. The bearing seat 15 is internally provided with at least one bearing sleeve which is set to be coaxial with the inner drum 1, and the middle part of the water guide sleeve 11 is installed in the bearing sleeve in a supporting manner. Preferably, the front and rear ends of the bearing seat 15 are respectively provided with one bearing sleeve. Further preferably, an inner diameter of a front bearing sleeve 16 is larger than an inner diameter of a rear bearing sleeve 17. The water guide sleeve 11 is provided with different axle segments which are respectively set to be corresponding to the front bearing sleeve 16 and the rear bearing sleeve 17, such that the front bearing sleeve and rear bearing sleeve respectively correspondingly fix and support the different axle segments of the water guide sleeve.

In the present embodiment, the periphery of the water guide sleeve 11 is further provided with a dynamic sealing ring 18. The dynamic sealing ring 18 is arranged between the bearing seat 15 and the supporting piece 20, and the periphery of the dynamic sealing ring 18 is abutted against the front end of the bearing seat 15 in a sealed manner, to prevent leakage of the washing water.

In the present embodiment, the drive motor 12 is arranged at the rear side of the supporting piece 20. The second end of the water guide sleeve 11 in sequence penetrates through the inner stator 14 and the outer rotor 13 of the drive motor 12. The center of the outer rotor 13 is provided with a spline hole which is fixedly connected with the axel segment, penetrating through the spline hole, of the water guide sleeve 11. The periphery of the axle segment of the water guide sleeve 11 is correspondingly provided with a matched external spline, such that the water guide sleeve 11 and the outer rotor 13 are fixedly connected with each other through the matched spline.

Figure 6:
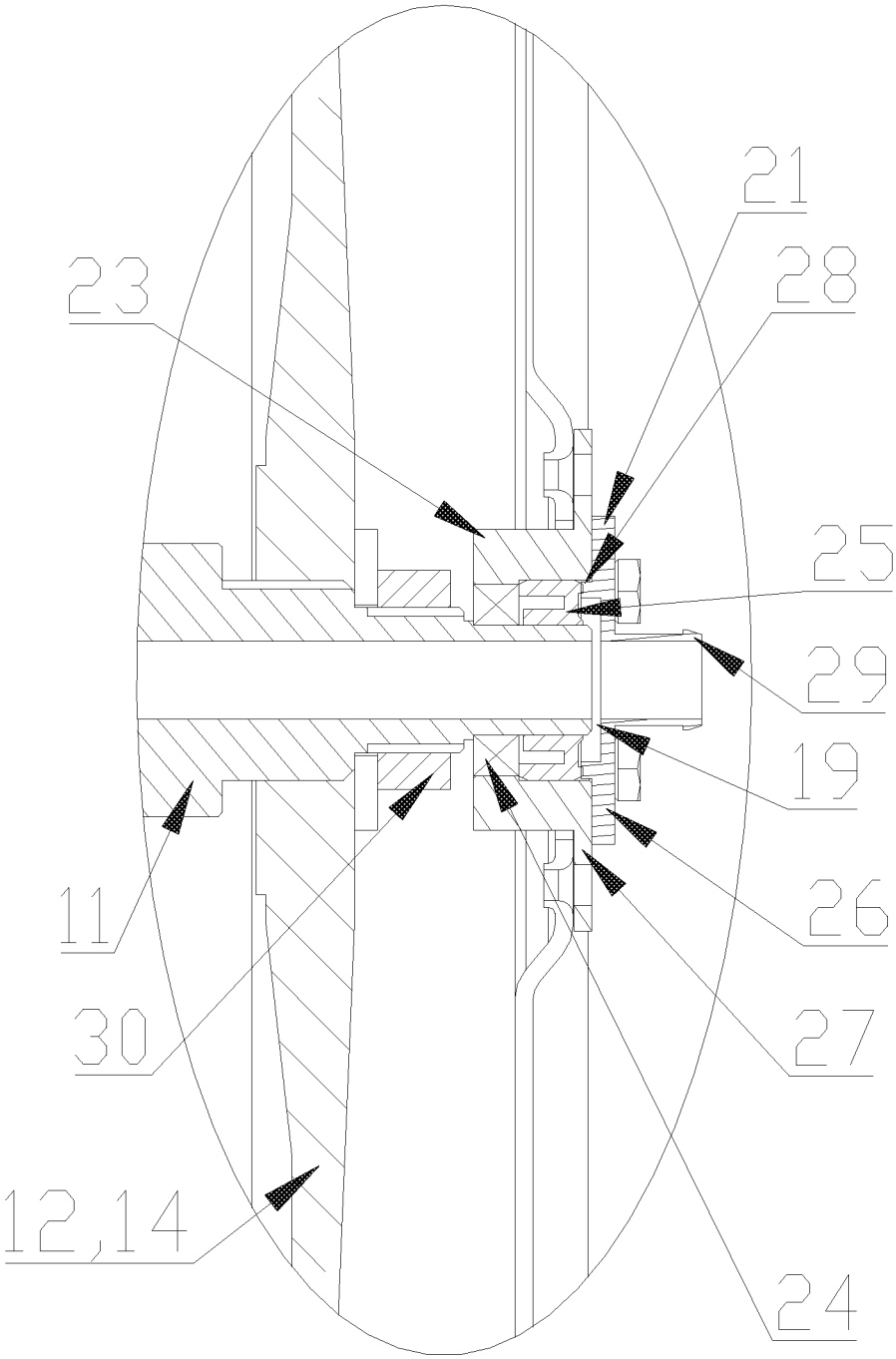
FIG. 6 is a schematic diagram of an enlarged structure of part C in FIG. 3 in an embodiment of the present disclosure.

As shown in FIG. 6, in the present embodiment, the second end of the water guide sleeve 11 penetrates out of the outer rotor 13. The second end being penetrated out is communicated with a water drainage pipe of the washing machine through a water outlet structure, such that the washing water is guided out of the washing machine. Preferably, the water outlet structure includes a sealed water flowing chamber 19. The water flowing chamber 19 is fixedly installed on the inner drum supporting piece 4. The outer side of the water flowing chamber 19 is communicated with a water outlet joint 21, and the inner side is communicated with the second end of the water guide sleeve 11. The end part of the water outlet joint 21 is communicated with the water drainage pipe of the washing machine, such that the washing water flowing into the water flowing chamber 19 from the water guide sleeve 11 flows out of the washing machine from the water drainage pipe through the water outlet joint 21.

In the present embodiment, multiple axle segments, with the outer circumference diameters being gradually decreased, are arranged on the water guide sleeve 11 from the first end to the second end, so as to assemble and install the water guide sleeve 11. The water guide sleeve can be assembled only when the water guide sleeve goes into the drive motor in sequence from a small-head end.

Embodiment 3

As shown in FIG. 1 to FIG. 9, the present embodiment is directed to a water outlet structure of a washing machine. The rear side of the inner drum supporting piece 4 of a washing machine is fixedly installed with a sealed water flowing chamber 19. The water flowing chamber 19 is provided with a water outlet joint 21 which is fixed with the inner drum supporting piece 4. The end part of the water guide sleeve 11 which rotates along with the inner drum 1 stick into the water flowing chamber 19, to discharge out the washing water flowing out of the inner drum 1 along the water guide sleeve 11.

Through the arrangement of a water flowing chamber at the rear side of the washing machine, the water guide sleeve, which guides washing water to flow outwards and rotates together with the inner drum, is connected with the water flowing chamber in dynamic seal manner, and then is directly connected with the water drainage pipe of the washing machine in a plug-in manner. Thereby it is avoided that the problems of nonsynchronous rotation and incapability of abutting are caused by direct abutment between the water guide sleeve and the water drainage pipe, and further it is realized that the washing water is guided by the water guide sleeve to smoothly discharge out of the washing machine.

As shown in FIG. 3 and FIG. 6, in the present embodiment, the rear side of the inner drum supporting piece 4 of the washing machine is fixedly installed with a fixed shelf 22. The fixed shelf 22 is fixedly installed with a water outlet joint 21. The fixed shelf 22 is provided with a sealed water flowing chamber 19 which is communicated with the water outlet joint 21. The end part of the water guide sleeve 11 which rotates along with the inner drum 1 sticks into the water flowing chamber 19, and the dynamic seal is handled on the connecting point where the water guide sleeve penetrate. The washing water flowing out of the inner drum 1 is guided along the water guide sleeve 11 to the water flowing chamber 19, and then flows out through the water outlet joint 21.

In the present embodiment, the center of the fixed shelf 22 is provided with a through hole which is set to be coaxial with the inner drum 1. The through hole is installed with a mounting sleeve 23 with a barrel-shaped contour which is set to be coaxial with the inner drum 1. A front side of the mounting sleeve 23 is in sealing connection with the end part of the water guide sleeve 11 in a plug-in manner, and a rear side is in sealing connection with the water outlet joint 21, such that the hollow part of the mounting sleeve 23 encircles the sealed water flowing chamber 19.

As shown in FIG. 6, in the present embodiment, the mounting sleeve 23 is provided from front to back in sequence with a bearing sleeve 24 and a dynamic sealing sleeve 25. The bearing sleeve 24 is used for positioning support on the water guide sleeve 11, and the dynamic sealing sleeve 25 seals the water guide sleeve 11. The bearing sleeve 24 and the dynamic sealing sleeve 25 are correspondingly sleeved on the periphery of the water guide sleeve 11, and the periphery of the dynamic sealing sleeve 25 is in sealed fit and contact with an inner wall of the mounting sleeve 23.

In the present embodiment, the water outlet joint 21 includes a flange plate 26 which covers the rear side of the mounting sleeve. The flange plate 26 is in sealed connection with the rear side of the mounting sleeve 23. The center of the flange plate 26 is provided with a water outlet 29 which is set to be coaxial with the inner drum 1, and the water outlet 29 is correspondingly communicated with the water flowing chamber 19. Preferably, the water outlet 29 is a barrel-shaped opening which protrudes and extends backwards from the flange plate 26. Further preferably, the front side of the flange plate 26 is provided with a ring of limit ribs 28 which protrude towards the inside of the mounting sleeve 23. An end part of the limit rib 28 is abutted against the dynamic sealing sleeve 25. The outer circumference diameter of the limit rib 28 is set to be equal to the inner circumference diameter of the mounting sleeve 23, such that the limit rib 28 is in corresponding fit and contact with the inner wall of the mounting sleeve 23.

An elastic sealing gasket can be arranged at the contact point between the flange plate 26 and the mounting sleeve 23, to improve tightness of the connecting point of the two and tightness of the water flowing chamber.

In the present embodiment, two sides of the mounting flange plate 27 are respectively in fit and contact with the flange plate 26 and the fixed shelf 22. The mounting flange plate 27 is fixedly connected with the flange plate 26 and the fixed shelf 22 respectively through a bolt. Preferably, an outer circumference diameter of the flange plate 26 is larger than an inner circumference diameter of the mounting sleeve 23, and is smaller than an outer circumference diameter of the mounting flange plate 27. In the present embodiment, the mounting flange plate 27, the flange plate 26 and the fixed shelf 22 can be fixedly connected through the same bolt which penetrates through in sequence. The mounting flange plate 27 and the flange plate 26 as well as the mounting flange plate 27 and the fixed shelf 20 can also be respectively fixedly connected through different bolts.

In the present embodiment, the dynamic sealing sleeve 25 is a sealing ring with a C-shaped cross section. Two ends of the dynamic sealing sleeve 25 are respectively limited with and abutted against the flange plate 26 of the water outlet joint and the bearing sleeve 24. Preferably, an opening side of the sealing ring with C-shape is set facing the bearing sleeve 24, to ensure to be dynamic sealing from inside to outside to the greatest extent, and further improve tightness of the connecting point between the water guide sleeve and the water flowing chamber.

As shown in FIG. 6 and FIG. 7, in the present embodiment, the fixed shelf 22 is a strip plate which extends vertically and which is symmetrical to the axis of the inner drum 1. Two ends of the fixed shelf 22 are respectively bent towards the inner drum 1. The bending part is respectively fixedly connected with the rear side of the inner drum supporting piece 4. The mounting sleeve 23 is arranged in the center of the fixed shelf 22, and is set to be coaxial with the shaft of the inner drum 1.

In the present embodiment, the rear side of the inner drum supporting piece 4 is fixedly installed with a drive motor 12 which is set to be coaxial with the inner drum 1. The drive motor 12 is arranged between the fixed shelf 22 and the inner drum supporting piece 4. The drive motor 12 is separated from the fixed shelf 22 and the inner drum supporting piece 4 respectively by a certain gap. Preferably, the water guide sleeve 11 penetrates through the drive motor 12 and is in fixed engagement with the outer rotor 13 of the drive motor 12. The periphery of the water guide sleeve 11 is sleeved with a limit sleeve 30. The limit sleeve 30 is arranged between the outer rotor 13 and the mounting sleeve 23, and an outer circumference diameter of the limit sleeve 30 is larger than a diameter of the bearing sleeve 24, to prevent the bearing sleeve 24 from falling off from the mounting sleeve 23.

Embodiment 4

As shown in FIG. 1 to FIG. 9, the present embodiment introduces an inner drum applicable to the above no-clean washing machine. The inner drum 1 is provided with lifting ribs 2 which extend along a generatrix of the inner drum, each of the lifting ribs 2 is hollow inside. A water-splashing surface of each of the lifting ribs 2 is provided with permeable holes 8 to allow a hollow part of each of the lifting ribs to be communicated with an inside of the inner drum 1. A rear end of each of the lifting ribs 2 is arranged to be close to an inner drum bottom 6, and provided with a water outlet structure, to guide washing water in the inner drum 1 to the rear side of the inner drum under a blocking effect of the lifting ribs 2, and guide washing water to flow out of the inner drum 1 through a water guide flow channel 3 arranged on the inner drum bottom 6.

Via setting the lifting ribs on the side wall of the inner drum, when the inner drum rotates at a high speed, washing water which flows adherence to the side wall flows to the inside of each of the lifting ribs under the blocking effect of the lifting ribs, and under the effect of the centrifugal force, washing water flows towards the inner drum bottom along an internal chamber of each of the lifting ribs, thereby avoiding low efficiency of water drainage caused by turbulence of washing water.

As shown in FIG. 1 and FIG. 2, in the present embodiment, the inner drum bottom 6 is provided with water guide flow channels 3 which extend towards a center from a periphery of the bottom, ends, at the peripheral of the bottom, of the water guide flow channels 3 and the lifting ribs 2 are corresponding one by one. Each of the lifting ribs 2 and each of the water guide flow channels 3 corresponding to each of the lifting ribs 2 are arranged in a same radial section of the inner drum 1, such that the washing water guided to the inner drum bottom 6 by the lifting ribs 2 directly flows into the corresponding water guide flow channel 3, to improve the water drainage efficiency.

By respectively setting each of the lifting ribs and each of the water guide flow channels correspondingly, washing water which is guided to flow to the inner drum bottom under the blocking effect of the lifting rib directly flows into the corresponding water guide flow channel. Further, the lifting ribs and the water guide flow channels are in one-to-one correspondence, which forms completely a water drainage channel, thereby improving water drainage flow rate and efficiency.

As shown in FIG. 8, in the present embodiment, the water outlet structure arranged on the rear end of each of the lifting ribs 2 is the permeable holes 8 arranged on the rear end of each of the lifting ribs 2, and/or a notch 9 arranged on a junction, being connected with the side wall of the inner drum of the washing machine, of the rear end of the lifting rib 2. Insides of each of the lifting ribs 2 are communicated with the inner drum 1 via the permeable holes 8 and/or the notch 9. Preferably, one end of each of the water guide flow channel 3 is arranged at the periphery of the inner drum bottom 6 in a manner of separating from the side wall of the inner drum 1 by a certain gap, the notch 9 is arranged at the junction, being connected with the side wall of the inner drum of the washing machine, of the rear end of the corresponding lifting rib. The notch 9 and the gap are arranged along the same generatrix of the inner drum in a manner of being close to each other. Further preferably, the rear end of the lifting rib 2 is separated from the inner drum bottom 6 by a certain gap, such that washing water in the inner drum flows into the water guide flow channel 3 through the gap.

As shown in FIG. 9, in the present embodiment, the hollow part of each of the lifting ribs 2 is provided with a baffle plate 31 which extends along the generatrix of the inner drum 1. The baffle plate 31 divides the hollow part of each of the lifting ribs 2 into two parts which are independent to each other, and the two parts are respectively communicated with the inner drum 1 via the permeable holes 8 arranged on the water-splashing surface corresponding to each of the two parts.

In the present embodiment, the baffle plate 31 extends along a center line of each of the lifting ribs 2, the two parts which are independent to each other at two sides of the baffle plate 31 are respectively communicated with the water outlet structure arranged on the rear end of each of the lifting ribs 2, such that washing water in the two parts can be discharged to the corresponding water guide flow channel 3 through the water outlet structure arranged on the rear end of each of the lifting ribs 2. Preferably, two independent chambers divided by the baffle plate 31 inside the lifting rib 2 are respectively communicated with the permeable holes 8 arranged at the rear end of the lifting rib 2.

In the present embodiment, a left side surface and a right side surface of the baffle plate 31 are both inclined surfaces which incline from the inner drum bottom 6 to an opening of the inner drum along a direction far away from an axis of the lifting rib 2, to guide washing water inside the lifting rib 2 to converge and flow towards a center of the rear end of the lifting rib 2 along the baffle plate 31, such that the washing water directly flows into the corresponding water guide flow channel 3 through the water outlet structure on the rear end of the lifting rib 2.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. An inner drum, comprising:

lifting ribs, provided in the inner drum and extending along a generatrix of the inner drum, wherein each of the lifting ribs is hollow, a water-splashing surface of each of the lifting ribs is provided with permeable holes to allow a hollow part of the each of the lifting ribs to communicate with an inside of the inner drum, and a rear end of each of the lifting ribs is arranged to be proximate to an inner drum bottom, and is provided with a water outlet, wherein the water outlet is configured as permeable holes arranged on the rear end of each of the lifting ribs, and/or a notch arranged on a junction, connected with a side wall of the inner drum of a washing machine, of the rear end of the lifting rib, water guide flow channels are arranged on the inner drum bottom and extend towards a center of the inner drum from a periphery;

the center of the inner drum bottom is provided with a central joint communicating with an end of each of the water guide flow channels, and a rear end of the central joint is provided with a water outlet connector penetrating through the inner drum bottom, and configured such that washing water in the inner drum flows to the central joint through the water guide flow channels under an effect of a centrifugal force, and then flows out of the inner drum through the water outlet connector.

2. The inner drum according to claim 1, wherein an interior of the lifting ribs communicates with the inner drum via the notch;

one end of each of the water guide flow channels is arranged at the periphery of the inner drum bottom and spaced from the side wall of the inner drum by a gap, the notch is arranged at the junction of the rear end of each corresponding lifting rib and the side wall of the inner drum of the washing machine, and the notch and the gap are arranged along a same generatrix of the inner drum to correspond to each other.

3. The inner drum according to claim 1, wherein the hollow part of each of the lifting ribs is provided with a baffle plate which extends along the generatrix of the inner drum, the baffle plate divides the hollow part of each of the lifting ribs into two parts which are independent to each other, and the two parts respectively communicate with the inner drum via the permeable holes arranged on the water-splashing surface corresponding to each of the two parts.

4. The inner drum according to claim 3, wherein the baffle plate extends along a center line of each of the lifting ribs, the two parts, which are independent to each other at two sides of the baffle plate, respectively communicate with the water outlet arranged on the rear end of each of the lifting ribs, so that washing water in the two parts is discharged into the water guide flow channels through the water outlet arranged on the rear end of each of the lifting ribs.

5. The inner drum according to claim 3, wherein a first side surface and a second side surface of the baffle plate are both inclined surfaces which incline from the inner drum bottom to an opening of the inner drum along a direction away from an axis of each of the lifting ribs, to guide washing water inside the lifting ribs to converge and flow towards a center of the rear end of each of the lifting ribs along the baffle plate, such that washing water flows into the water guide flow channels.

6. The inner drum according to claim 1, wherein the central joint is fixedly installed in the center of the inner drum bottom, the central joint includes a body which is a circular ring or a semi-sphere, the body of the central joint is hollow inside to constitute a water passage chamber, a periphery of the body of the central joint is provided with a water inlet which is connected with the water guide flow channels correspondingly, to guide washing water in the water guide flow channels into the water passage chamber.

7. The inner drum according to claim 6, wherein the inner drum is a sealed inner drum without dewatering holes, the inner drum is provided with an inner drum water outlet, including:

the rear end of the central joint provided with a water outlet connector which is set to be coaxial with the central joint and extends backwards;

the water outlet connector penetrates through the inner drum bottom, to allow the water passage chamber to communicate with an outside of the inner drum;

a penetrating end of the water outlet connector is connected with one end part of a water guide sleeve in a plug-in manner; and another end of the water guide sleeve communicates with a water outlet pipe of the washing machine, for discharging washing water flowing out of the inner drum to an outside of the washing machine.

8. An inner drum according claim 1, comprising:

lifting ribs, provided in the inner drum and extending along a generatrix of the inner drum, wherein each of the lifting ribs is hollow, a water-splashing surface of each of the lifting ribs is provided with permeable holes to allow a hollow part of the each of the lifting ribs to communicate with an inside of the inner drum, a rear end of each of the lifting ribs is arranged to be proximate to an inner drum bottom, and is provided with a water outlet, and the water outlet is configured as permeable holes arranged on the rear end of each of the lifting ribs, and/or a notch arranged on a junction, connected with a side wall of the inner drum of a washing machine, of the rear end of the lifting rib;

a water flowing chamber in a sealed state arranged on a rear side of an inner drum supporting piece of the washing machine;

a water outlet joint arranged on the water flowing chamber and fixed with the inner drum supporting piece, wherein an end part of a water guide sleeve rotating along with the inner drum is inserted into the water flowing chamber, to discharge washing water flowing out of the inner drum along the water guide sleeve.

9. The inner drum according to claim 8, wherein, a rear side of the inner drum supporting piece of the washing machine has a fixed shelf, the fixed shelf has a water outlet joint, the fixed shelf is provided with the water flowing chamber communicated with the water outlet joint, an end part of the water guide sleeve rotating along with the inner drum is inserted into the water flowing chamber, and is in a dynamic sealing state on a penetrating connecting point, and the washing water flowing out of the inner drum along the water guide sleeve is guided to the water flowing chamber, and then flows out through the water outlet joint.

10. The inner drum according to claim 9, wherein, a center of the fixed shelf is provided with a through hole being set to be coaxial with the inner drum, a mounting sleeve is installed on the through hole, with a barrel-shaped contour, and set to be coaxial with the inner drum, a front side of the mounting sleeve is connected with the end part of the water guide sleeve in a sealing and plug-in manner, a rear side is in sealing connection with the water outlet joint, and a hollow part of the mounting sleeve encircles the water flowing chamber.

11. The inner drum according to claim 10, wherein a bearing sleeve and a dynamic sealing sleeve are arranged in the mounting sleeve from front to back in sequence, the bearing sleeve is used for positioning support on the water guide sleeve, and the dynamic sealing sleeve seals the water guide sleeve, and the bearing sleeve and the dynamic sealing sleeve are correspondingly sleeved on a periphery of the water guide sleeve, and a periphery of the dynamic sealing sleeve is in sealed fit and contact with an inner wall of the mounting sleeve.

12. The inner drum according to claim 10, wherein the water outlet joint comprises a flange plate for covering a rear side of the mounting sleeve, the flange plate is in sealed connection with the rear side of the mounting sleeve, and a center of the flange plate is provided with a water outlet being coaxial with the inner drum, and the water outlet is communicated with the water flowing chamber.

13. The inner drum according to claim 11, wherein the dynamic sealing sleeve is a sealing ring with a C-shaped cross section, and two ends of the dynamic sealing sleeve are respectively limited with and abutted against the flange plate of the water outlet joint and the bearing sleeve.

14. The inner drum according to claim 9, wherein the fixed shelf is a strip plate which extends vertically and which is symmetrical to an axis of the inner drum, two ends of the fixed shelf are respectively bent towards the inner drum, bending parts are respectively fixedly connected with the rear side of the inner drum supporting piece, and the mounting sleeve is arranged in the center of the fixed shelf and is set to be coaxial with a shaft of the inner drum.

15. The inner drum according to claim 14, wherein, the rear side of the inner drum supporting piece is fixedly installed with a drive motor which is set to be coaxial with the inner drum, the drive motor is arranged between the fixed shelf and the inner drum supporting piece, and the drive motor is separated from the fixed shaft and the inner drum supporting piece respectively by a gap.

16. The inner drum according to claim 8, wherein a center of an inner drum bottom of the washing machine is provided with a water outlet portion which penetrates out of the inner bottom, a first end of the water guide sleeve is connected with the water outlet portion in a plug-in manner, to guide the washing water flowing out of the inner drum to flow to a water drainage pipe of the washing machine along the water guide sleeve;

the first end of the water guide sleeve is provided with a connecting structure fixed with the inner drum bottom, and the water guide sleeve is engaged and fixed with the rotor of the drive motor of the washing machine, such that the rotor of the drive motor drives the inner drum to rotate through the water guide sleeve.

17. The inner drum according to claim 16, wherein a supporting piece is fixedly installed on an outer side of the inner drum bottom, the supporting piece is set to be symmetrical relative to a center of the inner drum bottom, a center of the supporting piece is provided with a through hole for allowing the water outlet portion to penetrate through correspondingly, and the first end of the water guide sleeve is fixedly connected with the supporting piece, and is connected with the water outlet portion in a plug-in manner.

18. The inner drum according to claim 16, wherein the water guide sleeve extends along an axial direction of the inner drum, a rear end of the inner drum is provided with the inner drum supporting piece, the inner drum supporting piece is installed with the drive motor which is set to be coaxial with the inner drum, and a center of the rotor of the drive motor is fixedly connected with a periphery of a second end of the water guide sleeve.

19. The inner drum according to claim 18, wherein the center of the inner drum supporting piece is provided with a bearing seat with a barrel-shaped contour, the bearing seat is internally provided with at least one bearing sleeve which is set to be coaxial with the inner drum, and a middle part of the water guide sleeve is installed in the bearing sleeve in a supporting manner;

a front end and a rear end of the bearing seat are respectively provided with one bearing sleeve; and an inner diameter of the front bearing sleeve is larger than an inner diameter of the rear bearing sleeve, the water guide sleeve is provided with different axle segments which are respectively set to be corresponding to the front bearing sleeve and the rear bearing sleeve, and the front bearing sleeve and the rear bearing sleeves respectively support different axle segments of the water guide sleeve.

* * * * *